US005738116A

United States Patent [19]

Truelove

[11] Patent Number: 5,738,116

[45] Date of Patent: Apr. 14, 1998

[54] FLUID-COOLED SMOKING DEVICE

[76] Inventor: Michael T. Truelove, 7641 Victor Pike, Bloomington, Ind. 47403

[21] Appl. No.: 373,113

[22] Filed: Jan. 17, 1995

[51] Int. Cl.[6] ..... A24F 1/14

[52] U.S. Cl. ..... 131/173; 131/195; 131/231

[58] Field of Search ..... 131/173, 195, 131/210, 231, 187, 249, 330, 194

[56] References Cited

U.S. PATENT DOCUMENTS

| | | | |
|---|---|---|---|
| 586,149 | 7/1897 | Turner | 131/173 |
| 3,872,872 | 3/1975 | Kahler | 131/173 |
| 3,881,499 | 5/1975 | McFadden et al. | 131/173 |
| 3,882,875 | 5/1975 | Frost | 131/173 |
| 3,902,506 | 9/1975 | Hawie | 131/173 |
| 4,014,353 | 3/1977 | Kahler | 131/173 |
| 4,029,109 | 6/1977 | Kahler | 131/173 |
| 4,031,906 | 6/1977 | Knapp | 131/173 |
| 4,041,960 | 8/1977 | Kahler | 131/173 |
| 4,044,781 | 8/1977 | Heggestuen | 131/173 |
| 4,071,035 | 1/1978 | Boyd et al. | 131/173 |
| 4,111,214 | 9/1978 | Flesher | 131/173 |
| 4,133,318 | 1/1979 | Gross | 131/173 |
| 4,134,410 | 1/1979 | Kahler | 131/173 |
| 4,148,327 | 4/1979 | Graham | 131/173 |
| 4,183,365 | 1/1980 | Kelley | 131/180 |
| 4,203,455 | 5/1980 | Byrd, Jr. | 131/173 |
| 4,216,785 | 8/1980 | Erickson et al. | 131/173 |
| 4,253,475 | 3/1981 | Schreiber et al. | 131/173 |
| 4,638,815 | 1/1987 | Yoshioka | 131/173 |
| 4,682,610 | 7/1987 | Freelain | 131/173 |
| 5,080,113 | 1/1992 | Bui | 131/173 |

*Primary Examiner*—Vincet Millin
*Assistant Examiner*—Charles W. Anderson

[57] ABSTRACT

An improved fluid-cooled smoking device wherein the smoke is bubbled up through the fluid contained in one reservoir or housing and then mixes and flows with this fluid as it is flowing into another fluid containing reservoir or housing, which the smoke also bubbles up through, resulting in a cooler and cleaner smoking experience. Also the improved fluid-cooled smoking device allows for conveniently drawing in the smoke through the nose allowing one to smell the "bouquet" of a fine tobacco or to draw medicinal herb smoke into and through the sinus cavities.

10 Claims, 6 Drawing Sheets

FLUID-COOLED SMOKING DEVICE

BACKGROUND—CROSS-REFERENCES

The present invention in particularly the prime embodiment, uses the design of my pending design patent, application Ser. No. 29/022,099, filed Apr. 29, 1994.

BACKGROUND—FIELD OF INVENTION

The present invention relates broadly to smoking devices used for the combustion and inhalation of such combustibles, tobacco and medicinal herbs. With more particularity, this invention relates to a smoking device of the type that during inhalation, but before entering the lungs, the smoke is drawn through a cooling-fluid, such as water, scented water, wine or some other suitable liquid by which the inhalant is cooled and filtered, improving the quality of the smoking experience.

BACKGROUND—DESCRIPTION OF PRIOR ART

The use of cooling-fluid such as water, scented water, or wine in smoking devices is ancient. The hookaa, a form of a fluid-cooled smoking device of the Mid-east has been in use for centuries to smoke tobacco. The principle of these devices is that by first bubbling the smoke through a cooling-fluid the smoke is cooled, filtered and moistened giving the smoker a less harsh, less dry and a cleaner smoking experience than otherwise would be enjoyed. In recent times improvements have been attempted as shown in the following U.S. Pat. Nos.: 3,881,499 to McFadden and Barnhard (1975); 3,882,875 to Charles W. Frost (1975); 4,014,353 (1977), 4,029,109 (1977) and 4,134,410 (1979) all to Richard W. Kahler; 4,111,214 to Robert W. Flesher (1978); 4,071,035 to Boyd and McGillvray (1978); 4,148,327 to Roger Graham (1979); 4,216,785 to Erickson and Jarvie (1980); 4,253,475 to R. Schreiber and B. Schreiber (1981); 4,682,610 to Kenneth W. Freelain (1987). However to the best of my knowledge all previous devices fail to fully utilize the cooling and filtering effect of the cooling liquid. Most previous devices only bubble the smoke through the cooling fluid once and also fail to circulate the cooling fluid. In the case of a two cooling housing system, U.S. Pat. No. 4,148,327 to Roger Graham (1979) and U.S. Pat. No. 4,071,035 to Boyd (1978), they fail to take full advantage of the inherit potential of such a system. In the case of U.S. Pat No. 4,148,327, by placing the tube from the second chamber at the very top of the first fluid chamber the hottest smoke that bubbles up through the first chamber, is immediately drawn through the second fluid chamber which fails to take full advantage of the first chamber's cooling potential. Also U.S. Pat. No. 4,148,327 offers no means of circulating the cooking fluid. U.S. Pat. No. 4,071,035 has no effective means for the smoke to mix with the cooling fluid as it flows.

Another disadvantage of such prior art fluid-cooling pipes is that they offer no convenient means for drawing in the smoke through the nose to enjoy the "bouquet" of the tobacco or in the case of combustible medicinal herbs to draw the smoke through the nose and then through the sinus cavities.

OBJECTS OF THE INVENTION

With the foregoing in mind, it is a primary object of the present invention to alleviate or substantially alleviate the aforesaid disadvantages of the prior art in fluid-cooled smoking devices by providing a means to circulate the cooling liquid and to provide a convenient means of drawing the smoke in through the nose.

Accordingly it is a primary object of the present invention to provide a novel and improved fluid-cooled smoking device for smoking tobacco and/or medicinal herbs.

A paramount object of the present invention is to provide a means of having the smoke mix with and bubble through a flowing cooling fluid, efficiently cooling and cleaning the smoke.

Another object of the present invention is to provide a convenient means for drawing in the smoke through the nose to enjoy the "bouquet" of the tobacco or in the case of combustible medicinal herbs to draw the smoke through the nose and then through the sinus cavities.

Further novel features and other objects of this invention will become apparent from the following detailed description, discussion and the appended claims taken in conjunction with the accompanying drawings.

REFERENCE NUMERALS IN DRAWINGS

Figure 1:
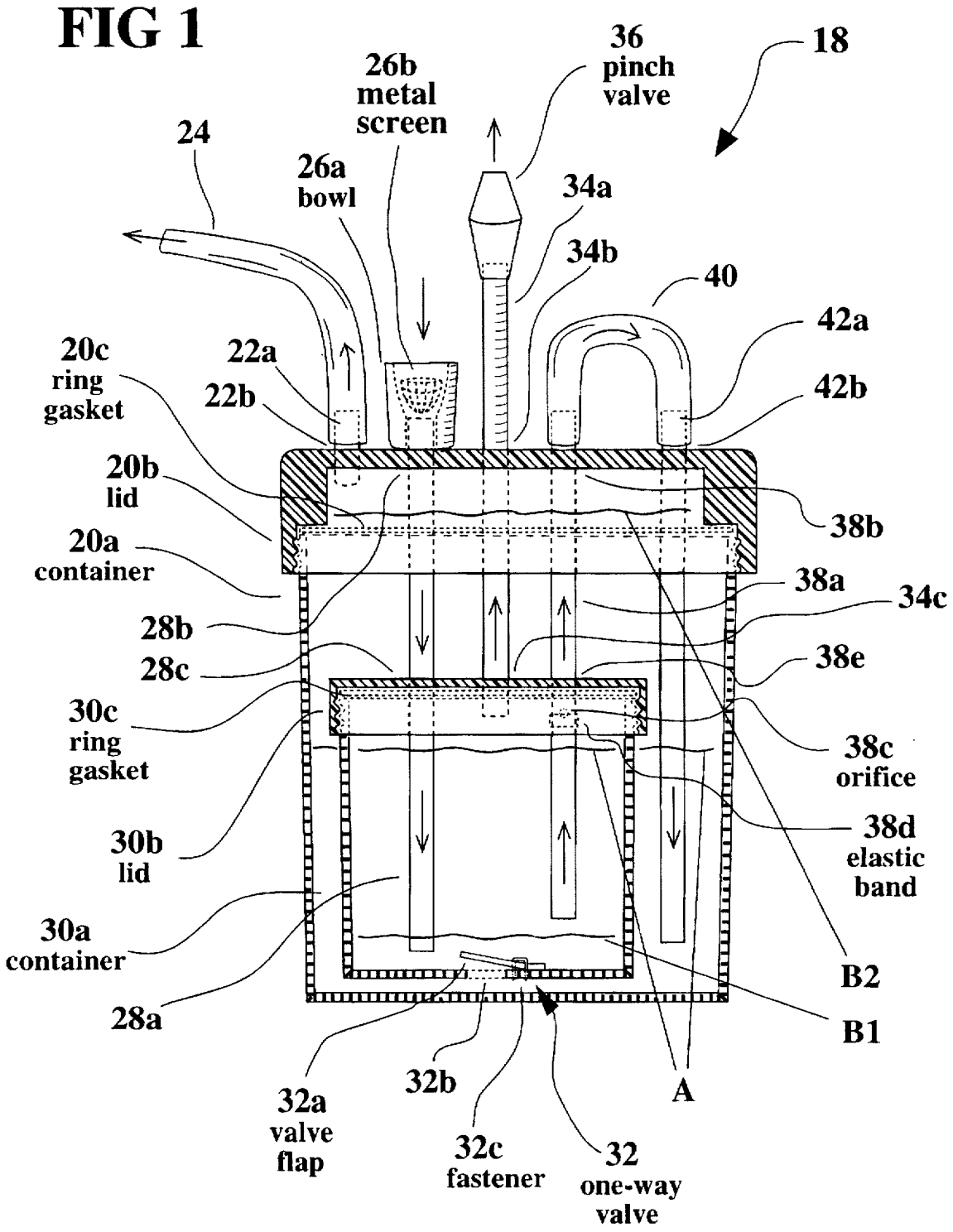
FIG. 1 shows a cross-sectional side view of the first embodiment of the invention, comprising an outer fluid chamber, a inner fluid chamber with a valve and also a tubular member connecting the two chambers.

| | | | |
|---|---|---|---|
| 18 | smoking device | 20 | housing |
| 20a | container | 20b | lid |
| 20c | ring gasket | 21a | housing |
| 21a | tube container | 21b | removable cap |
| 22a | tube | 22b | circular hole |
| 23 | open end of housing | 24 | flexible hose |
| 25 | elastic flexible hose | 26a | combustion bowl |
| 26b | metal screen | 28a | tube |
| 28b | circular hole | 28c | circular hole |
| 30 | housing | 30a | container |
| 30b | lid | 30c | ring gasket |
| 31a | groves | 31b | partition |
| 32 | one-way valve | 32a | valve flap |
| 32b | circular hole | 32c | fastener |
| 34a | tube | 34b | circular hole |
| 34c | circular hole | 35 | flexible hose |
| 36 | pinch valve | 37 | fastener |
| 38a | tube | 38b | circular hole |
| 38c | orifice | 38e | circular hole |
| 40 | flexible hose | 41 | circular hole |

-continued

| REFERENCE NUMERALS IN DRAWINGS | | | |
|---|---|---|---|
| 42a | tube | 42b | circular hole |
| 43 | base | A | fluid level |
| B1 | fluid level | B2 | fluid level |

DESCRIPTION OF THE PREFERRED EMBODIMENT

FIG. 1 to FIG. 4

Figure 2:
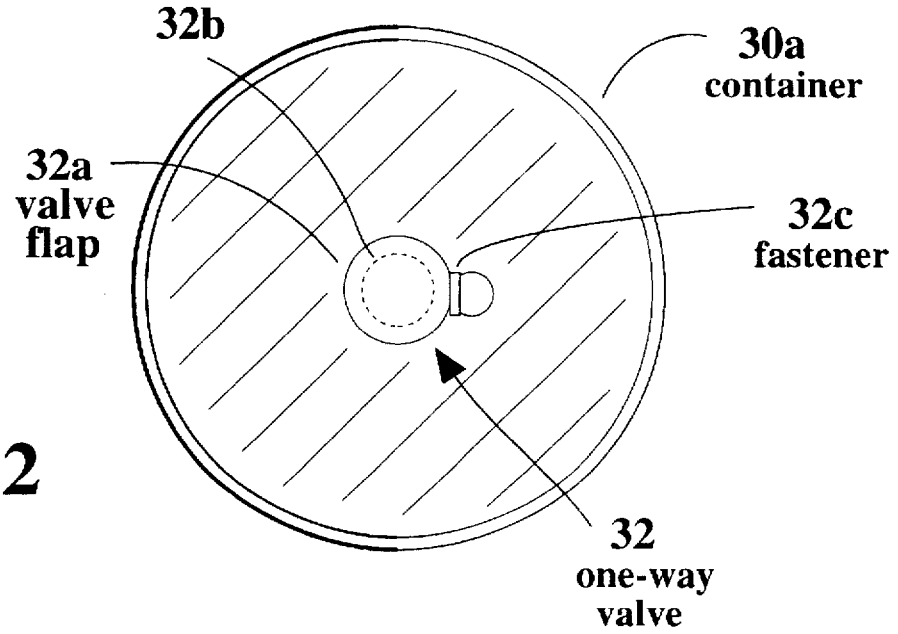
FIG. 2 shows an above view of just the bottom of the container 30*a* and the one-way valve 32 of the first embodiment of the invention.

Referring now to the drawings, and more particularly to FIG. 1, there is shown one embodiment of a fluid-cooled smoking device constructed in accordance with the present invention. FIG. 1 gives a cross-sectional side view of the present invention. The device includes a vertically disposed clear screw-top cylindrical housing 20. The housing consist of a container 20*a*, a screw-top lid 20*b* and a ring gasket 20*c*. The container 20*a* has a diameter of approximately 8.9 cm. (3.5 in.) and a height of approximately 11.5 cm. (4.53 in.). The screw-top lid 20*b* has a diameter of approximately 9.3 cm.(3.67 in.),and fits in a screw-on fashion onto the container 20*a*. The ring gasket 20*c* fits in a friction tight manner into the lid 20*b*. There is a vertically disposed tube 22*a* that passes in a friction-tight manner through a circular hole 22*b* in the lid 20*b*. The tube 22*a* has a length of approximately 1.26 cm. (0.5 in.). The tube 22*a* protrudes approximately 0.635 cm. (0.25 in.) above the top surface of the lid 20*b*. Attached in a friction-tight manner to the tube 22*a* is a clear flexible hose 24. There is a vertically disposed tube 28*a* that passes in a friction-tight manner through a circular hole 28*b* in the lid 20*b*. The tube 28*a* has a length of approximately 11.43 cm. (4.5 in.). The tube 28*a* protrudes approximately 0.9525 cm. (0.375 in.) above the top surface of the lid 20*b*. Resting on the top of lid 20*b* and encompassing the upper end of the tube 28*a* is a bowl 26*a* having a diameter of approximately 1.9 cm. (0.75 in.) and a height of approximately 2.54 cm. (1 in.). Located inside the upper part of the bowl 26*a* and just above the upper end of the tube 28*a* is a metal screen 26*b*. The tube 28*a* also passes in a friction-tight manner through a hole 28*c* located in a screw-top lid 30*b*. The lid 30*b* has a diameter of approximately 7.14 cm. (2.8125 in.). The lid has a inside ring gasket 30*c*. The bottom end of the tube 28*a* extends down to within approximately 0.635 cm. (0.25 in.) of the inside bottom surface of a housing 30. The housing consist of a container 30*a*, a screw-top lid 30*b* and a ring gasket 30*c*. The container 30*a* has a diameter of approximately 7 cm. (2.756 in.) and a height of approximately 5.8 cm (2.283 in.). The container 30*a* fits in a screw-in fashion into the lid 30*b*. The ring gasket 30*c* fits in a friction tight manner within the lid 30*b*. Located in the center of the bottom of the container 20*a* is a horizontally disposed normally-open flap valve 32. Now referring to FIG. 2, the valve 32 consist of a plastic flap 32*a*, consisting of two joined disks. One disk has a diameter of approximately 1.9 cm. (0.75 in.) and the other disk has a diameter of approximately 0.635 cm.(0.25 in.). The valve flap 32*a* has a thickness of approximately 0.15 cm.(0.059 in.). There is a fastener 32*c* shaped in like the character "n", vertically positioned and permanently attached to the inside bottom surface of the container 30*a*. The fastener 32*c* straddles the valve flap 32*a* and holds it so that the larger disk of the valve flap 32*a* is centered above a 1.26 cm. (0.5 in.) circular hole 32*b* that is located in the center of the bottom of the container 30*a*. Now referring again to FIG. 1, there is a vertically disposed tube 34*a* that passes in a friction-tight manner through a circular hole 34*b* in the lid 20*b*. The tube 34*a* has a length of approximately 8.89 cm. (3.5 in.). The tube 34*a* protrudes above the top surface of the lid 20*a* approximately 3.49 cm.(1.375 in.). Attached in a friction-tight manner to the upper end of the tube 34*a* is a normally-closed pinch valve 36. The tube 34*a* also passes in a friction-tight manner through a hole 34*c* in the lid 30*b*. The tube 34*a* extends down from the inside surface of the lid 30*a* approximately 0.953 cm. (0.375 in.). There is a vertically disposed tube 38*a* that passes in a friction-tight manner through a hole 38*b* in the lid 20*b*. The tube 38*a* has a length of approximately 10.5 cm. (4 in.). The tube 38*a* protrudes 0.635 cm. (0.25 in.) above the top surface of the lid 20*a*. The tube 38*a* extends down to within approximately 1.27 cm. (0.5 in.) of the bottom inside surface of the container 30*a*. The tube 38*a* also passes in a friction-tight manner through a circular hole 38*e* in the lid 30*a*. In the wall of the tube 38*a*, there is a small circular hole 38*c* having a diameter of approximately 0.078 cm.(0.031 in.). The hole 38*c* is located just below the inside surface of the lid 30*b*. Attached in a friction-tight manner to the upper end of the tube 38*a* is a flexible hose 40. The other end of the hose 40 is attached to a vertically disposed tube 42*a*. The tube 42*a* has a length of 10.16 cm. (4 in.). The tube 42*a* passes in a friction-tight manner through a circular hole 42*b* in the lid 20*b* and protrudes approximately 0.635 cm. (0.25 in.) above the top surface of the lid 20*b*.

OPERATION OF THE INVENTION

Figure 3:
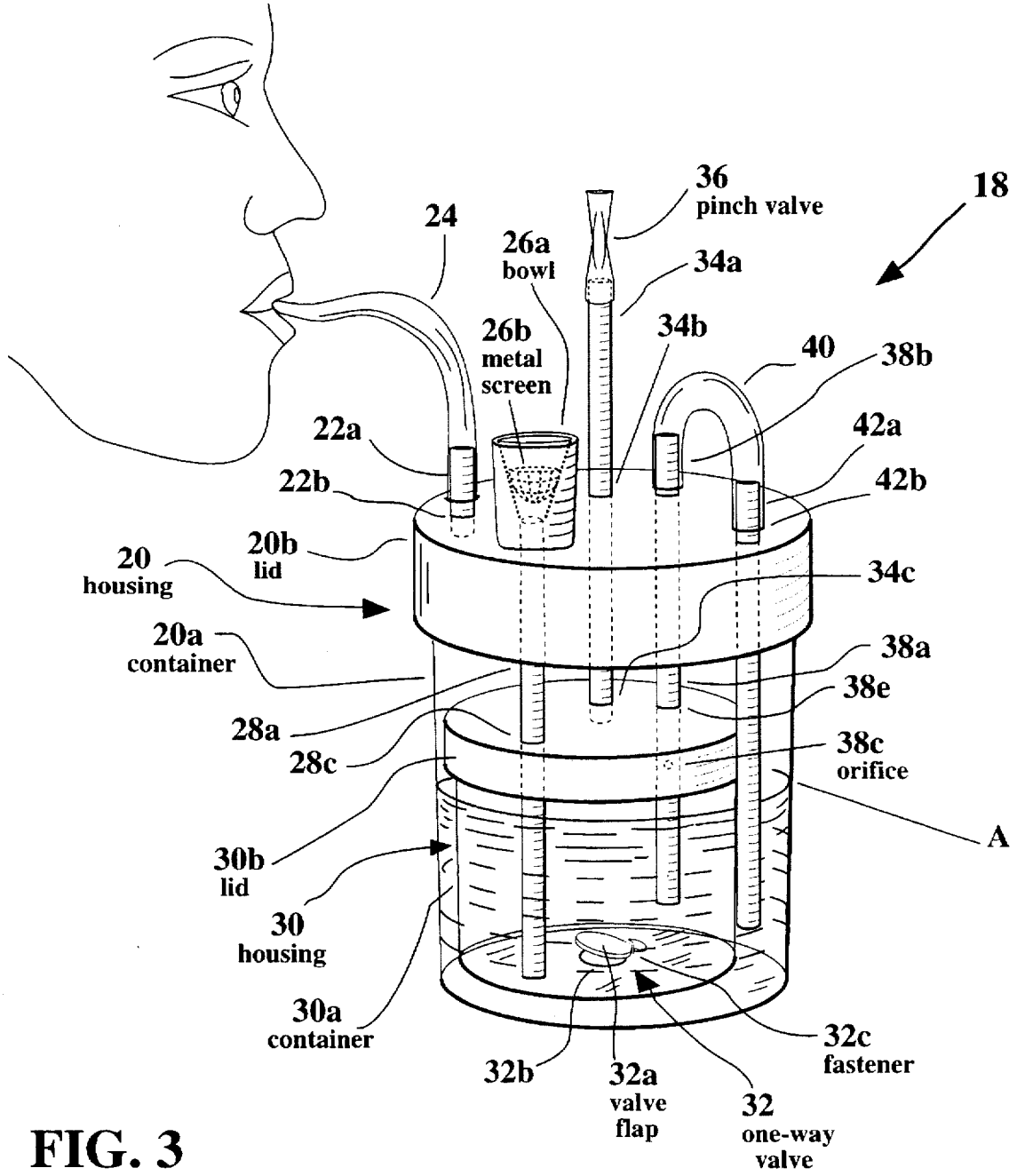
FIG. 3 shows an elevated perspective of the first embodiment in accordance with the principles of the invention. It also illustrates the proper way of drawing smoke into the lungs from the invention.

Referring to FIG. 3. The lid 20*b* is unscrewed from the Container 20*a*. You then fill the container 20*a* approximately half full of with water or some other appropriate liquid such as scented water or wine. The lid 20*b* is then screwed back on to the container 20*a*. As the lid 20*b* is being screwed on to the container 20*a* the open flap valve 32 will allow the cooling liquid to flow into the container 30*a*. The level of the cooling liquid in both of the containers, 20*a* and 30*a*, will be as shown by line A. You next place an appropriate combustible material such as tobacco into the bowl 26*a*. You place the end of the hose 24 in your mouth and draw air in from the hose 24 while at the same time placing a lit match just over the bowl 26*a*. Now referring to FIG. 1, the air and flame will be drawn down into the bowl 26*a* igniting the combustible material in the bowl 26*a*. The smoke will be drawn down the tube 28*a* and will bubble up into the container 30*a*. The pressure from drawing on hose 24 causes the flap valve 32*a* to close and seal the hole 32*b*. Because 38*a* is now the only open path between the chamber of housing 20 and the chamber or housing 30, the pressure exerted by the drawing of air from the housing 20 is exerted on the bottom open end of the tube 38*a* and also on the small orifice 38*c*. Since the orifice 38*c* is much smaller than the opening at the bottom end of the tube 38*a*, most of the pressure is felt at the opening at the bottom end of the tube 38*a*. Also since this opening is below the surface of the cooling fluid, the cooling liquid flows up through the tube 38*a* then through the hose 40 and then down through the tube 42*a*. This results in the fluid level rising in the container 20*a* and the fluid level falling in the container 30*a*. Some of the smoke that has bubbled up into the chamber or housing 20) will be drawn through the hole 38*c* into the tube 38*a* and flow, mixing with the cooling liquid that is being drawn up through the tube 38*a*. It should be noted that the orifice 38*c* is not necessary for the function of the invention, but adds to the inventions efficiency in cooling and filtering the smoke. At some point the lower end of the brass tube 38*a* is no longer below the surface of the cooling liquid and therefore no further cooling liquid is drawn up through the tube 38*a*. The fluid level in the housing 20 is now at B2 and the fluid level in the housing 30 is B1. Smoke as it cools in the housing 30 falls to just above the cooling fluid surface. This smoke is drawn up through the tube 38*a*, through the hose 40, down through the tube 42*a*. The smoke then bubbles up through the cooling fluid in the housing 20, is drawn through the tube 22, and through the hose 24. After a person has drawn in as much of the cooled filtered smoke as they want they remove the hose from their mouth. Now the cooling-liquid level in the housing 30 and the housing 20 will remain at respectively B1 and B2. The housing 30 fluid level is low and may contain smoke. The amount of smoke remaining in the housing 30 will depend on how long you have drawn smoke from the hose 24 and depending on how much combustible material was placed in the bowl 26*a*. Now you can either draw in again from the hose 24 or you can place your nose or mouth just above the upper end of the pinch valve 36 and then by squeezing the pinch valve 36 with your fingers the pinch valve will open allowing the smoke in the housing 30 to stream up and through the tube 34*a*, through the pinch valve 36 and then either you can draw it in through your nose, sinus cavities and into your lungs or into your mouth and lungs. The smoke is being pushed up and out of the housing 30 by the rush of cooling liquid from the housing 20 that now enters the housing 30 through the open flap valve 32. The cooling liquid level in the housing 30 will rise until it has reached equilibrium with the level of the cooling liquid in the housing 20. In FIG. 1 this level is depicted by line A.

Figure 4:
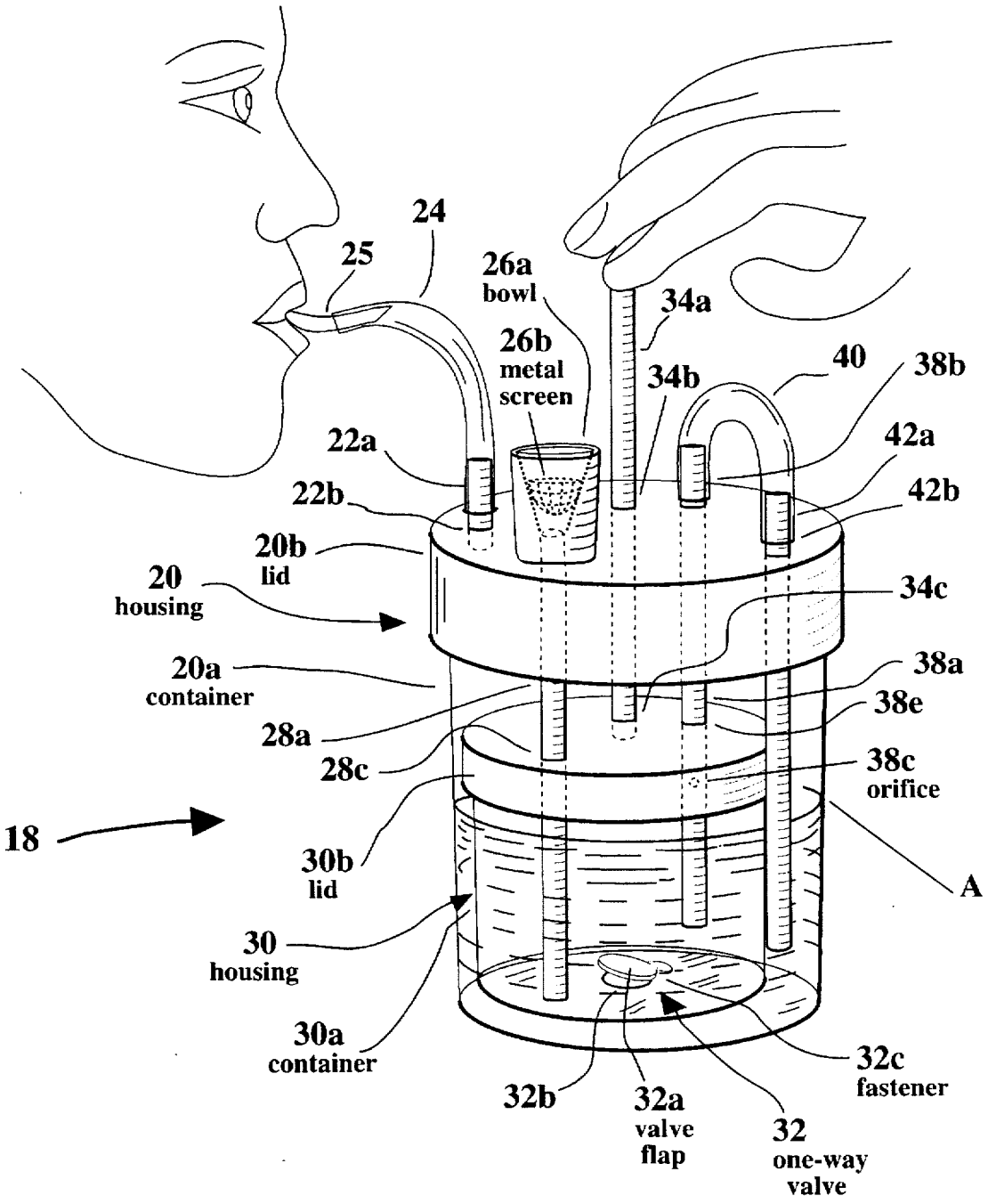
FIG. 4 shows exactly the same perspective representation as FIG. 3 except it shows a simplified version of the first embodiment invention having no pinch valve. see (FIG. 3, part 36).

FIG. 4 shows a slightly different variation of the first embodiment in which the pinch valve 36, is eliminated. Inserted in a friction tight manner into the end of the hose 24 is a flexible elastic hose 25. The operation of this variation on the first embodiment is the same, except that just before you draw air from the hose 25, you place a finger in an air tight manner over the top end of the tube 34*a*. After finishing drawing the smoke into the lungs you immediately squeeze the hose 25, in a closing or sealing fashion, between your thumb and index finger. Since the hose 25 is the only way for air to enter the housing 20, the fluid level in the housing 20 will remain at approximately line B2 and the fluid level in the housing 30 will remain at approximately line B1. The housing 20 water level is low and may contain smoke. The amount of smoke remaining in the housing 30 will depend on how long you have drawn smoke from the hose 24 and depending on how much combustible material was placed in the bowl 26*a*. Now you can either draw in again from the hose 25 or you can place your nose or mouth just above the upper end of the tube 34*a* and then by releasing the finger pressure on the hose 25 the smoke in the housing 30 will stream up and through the tube 34*a*, and then either you can draw it in through your nose, sinus cavities and into your lungs or into your mouth and lungs.

SECOND EMBODIMENT

FIG. 5 to 7

Figures 5, 6:
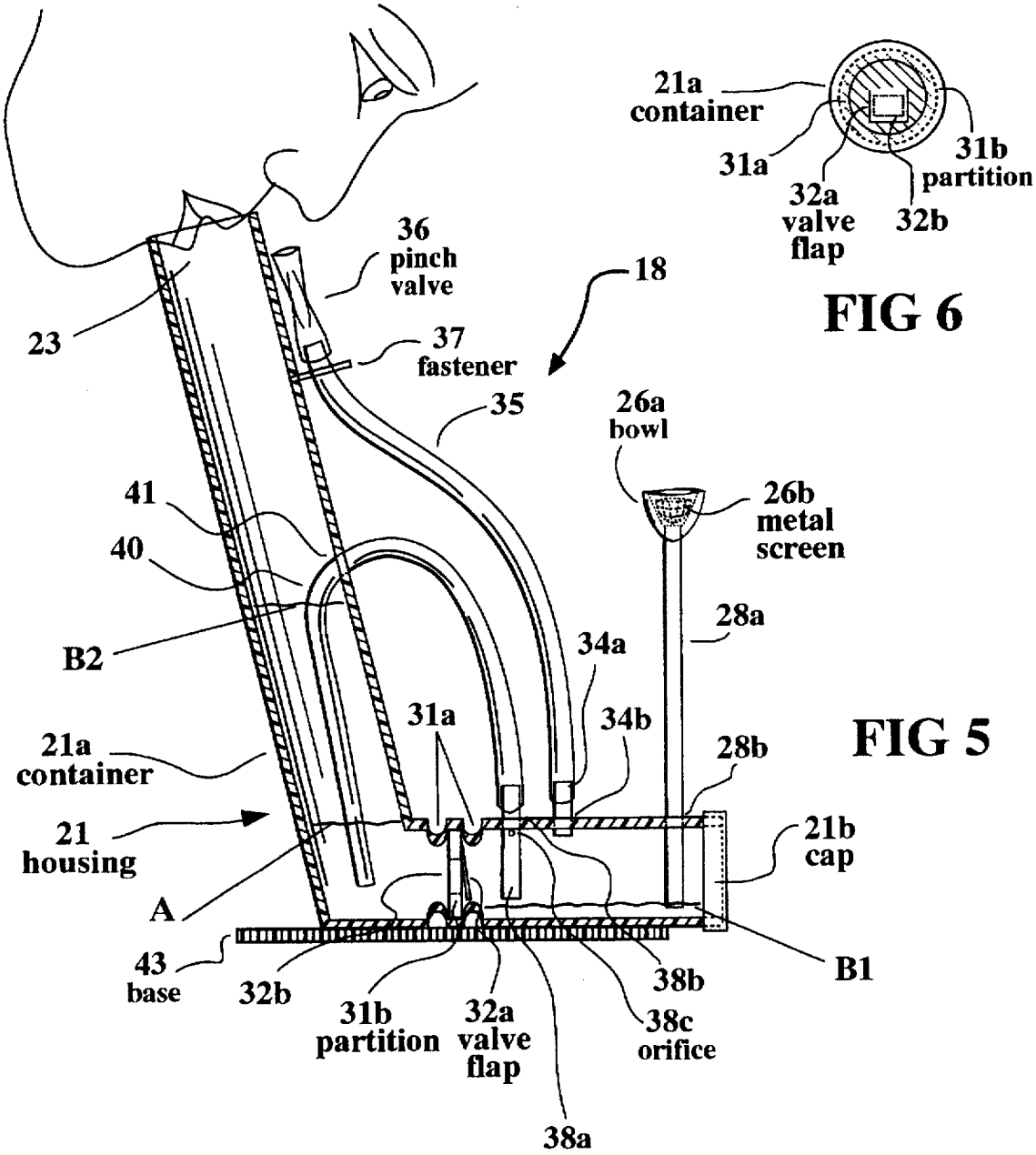
FIG. 5 shows a side perspective of a second embodiment in accordance with the principles of the invention, comprising an "L" shaped tube, divided into two chambers by a partition. It also illustrates the proper way of drawing smoke into the lungs from the invention.
FIG. 6 shows a side perspective of the partition and valve of the second embodiment of the invention.
Figure 7:
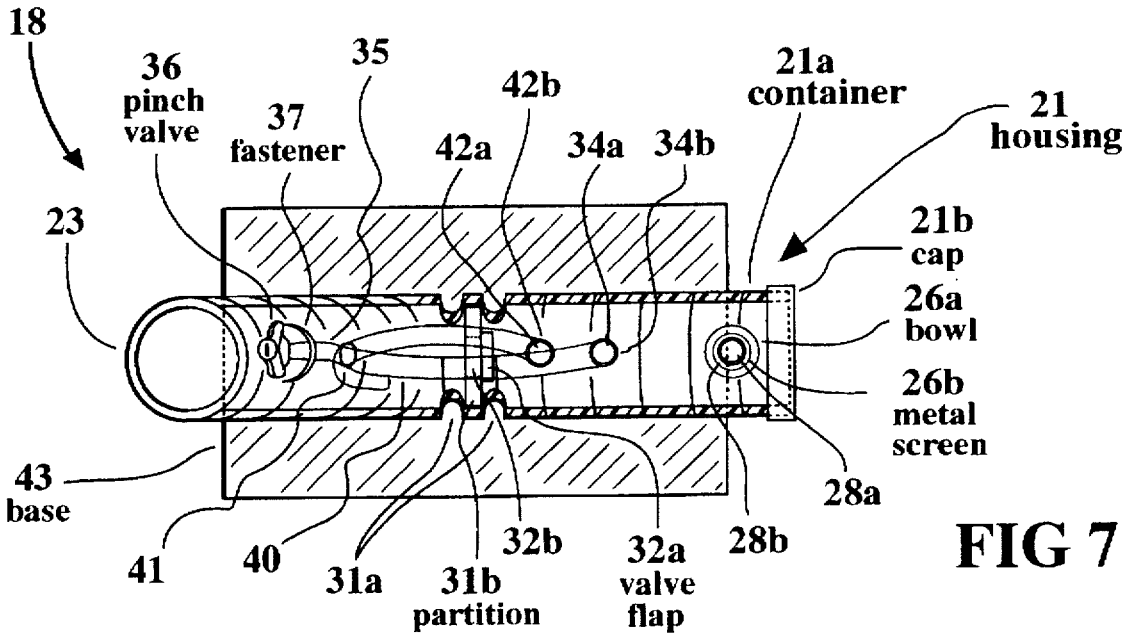
FIG. 7 shows a top perspective of the second embodiment of the invention.

Referring now to the drawings and more particularly to FIG. 5, there is shown a level perspective of another embodiment of a fluid-cooled smoking device constructed in accordance with the present invention and generally indicated by the reference character 18. Since this embodiment substantially differs from the previous embodiment I will give a detailed description. The fluid-cooled smoking devise comprises a housing 21, consisting of a vertically disposed "L" shaped cylindrical tube or tube container 21*a* which is open at its upper end 23 and has a removable fluid-tight cap 21*b* on its other end. The tube container 21*a* has a diameter of approximately 3.8 cm.(1.5 in.) and has a length of approximately 45 cm.(17.7 in.). The horizontally disposed section of the tube container 21*a* is approximately 17.8 cm.(7 in.) in length. There is a removable circular partition 31*b* located in a friction tight manner between two parallel troughs 31*a*. Now referring to FIG. 6 therein is a view of the partition 31*b*. Near the center of the partition 31*b* is a hole or opening 32*b* and a plastic normally-open flap valve 32*a*. Now referring to FIG. 5, the troughs 31*a* run the complete circumference of the tube container 21*a*. They are located approximately 12.7 cm.(5 in.) from the cap 21*b*. Located between the partition 31*b* and the cap 21*b* is a vertically disposed tube 38*a* that passes in a friction tight manner through a hole 38*b* in the tube container 21*a*. The tube 38*a* is approximately 2.8 cm.(1.1 in) length. The tube 38*a* protrudes above the surface of the tube container 21*a* approximately 0.625 cm.(0.25 in.). Attached in a friction-tight manner to the upper end of the tube 38*a* is a clear flexible hose 40. The hose 40 passes in a friction-tight manner through a hole 41. The hose 40 extends down almost to the bottom wall of the tube container 21*a*. There is a orifice 38*c* having a diameter of approximately 0.078 cm. (0.031 in.) in the tube 38*a*. The orifice 38*c* is located approximately 1.25 cm.(0.5 in.) from the upper end of the tube 38*a*. This places the orifice 38*c* near the upper inside wall of the tube container 21*a*. Located between the tube 38*a* and the cap 21*b* is a vertically disposed tube 34*a*. The tube 34*a* passes in a friction-tight manner through a hole 34*b* in the tube container 21*a*. The tube 34*a* is app. 1.27 cm.(0.5 in.) length. The tube 34*a* protrudes a distance of 0.625 cm.(0.25 in.) above the surface of the tube container 21*a*. Attached in a friction-tight manner to the upper end of the tube 34*a* is a clear flexible hose 35. Attached in a friction-tight manner to the upper end of the hose 35 is a normally-closed pinch valve 36. There is a clasp 37 attached in a permanent fashion to the tube container 21*a*. The clasp 37 loosely holds the hose 35 against the tube container 21*a*. Located between the tube 34*a* and the cap 21*b* is a vertically disposed tube 28*a*. The tube 28*a* passes in a friction-tight manner through a hole 28*b* in the tube container 21*a*. The tube 28*a* is app. 13 cm.(5.12 in.) length. The tube 28*a* protrudes above the outer surface of the tube container 21*a* approximately 10 cm.(4 in.). Attached in a screw-tight fashion on the upper end of the tube 28*a* is a smoking bowl 26*a*. Within the smoking bowl 26*a* is a fine mesh metal screen 26*b*. There is a base 43 that is attached in a permanent fashion to the outer bottom wall of the tube container 21*a*. The base 43 is attached in a length-wise horizontal position to the tube container 21*a*. The base 43 has a length of 14.6 cm.(5.75 in.), a width of 8.9 cm.(3.5 in.) and a thickness of 0.635 cm.(0.25 in.).

OPERATION OF THE SECOND EMBODIMENT

Referring now to FIG. 5 for the operation of the second embodiment, the tube or housing 21*a* is filled with the cooling fluid to a height as referred to by line A. This is done by pouring the cooling fluid into the opening 23. You then place some appropriate combustible in the bowl 26*a*. Next while holding a flame over the bowl 26*a* you place your mouth into the opening 23 and draw air into the lungs. This draws the flame down into the bowl igniting the combustible material in the bowl 26*a*. The remainder of the operation of the second embodiment of the invention proceeds in the same manner as for the first embodiment.

CONCLUSION, RAMIFICATIONS AND SCOPE OF THE INVENTION

Thus the reader can see that the construction of the invention provides a means for circulating the cooling fluid which results in a more efficient and effective use of the cooling fluid. This results in a cooler and better filtered smoking experience. The reader can further see that the construction of the invention provides for a convenient method for drawing in the smoke through the nose and sinus cavities.

While my above description contains many specificities these should not be construed as limitations on the scope of the invention, but rather as an exemplification of two preferred embodiment thereof. Many other variations are possible. Accordingly, the scope of the invention should be determined not by the embodiments illustrated, but by the appended claims and their legal equivalents.

The embodiments of the present invention presented herein are for illustrative purposes only and are not intended to restrict the scope of the invention in any way, any embodiment of the invention within the scope and breadth of the appended claims being intended to be embraced thereby. All embodiments within the meaning and range of equivalency of the appended claims are intended to be embraced therein. The invention may be embodied in other specific forms than those illustrated or mentioned herein without departing from the spirit or essential characteristics thereof.

What is claimed and desired to be protected by United States Letters Patent is:

1. A fluid-cooled smoking device comprising:

(a) housing means, for containing a volume of fluid;

(b) a second housing means for containing a volume of fluid;

(c) means for containing a supply of tobacco or/and medicinal herbs to be smoked;

(d) means operatively connected to said tobacco or/and medicinal herb container means for introducing smoke below the surface level of said fluid in said first housing;

(e) tubular means connecting said first housing to said second housing, wherein one end of tubular means extends below the surface of said fluid in said first housing and that the other end of said tubular means extends below the surface of said fluid in said second housing;

(f) means operatively connected to said second housing and projecting outwardly therefrom for withdrawing said smoke from said second housing;

(g) means operatively connected to said first housing and to said second housing for allowing the flow of said fluid from said second housing to said first housing, unless said withdrawing smoke means is engaged;

(h) means operatively connected to said first housing for venting said first housing.

2. A fluid-cooled smoking device as set forth in claim 1, wherein said tubular means has a small orifice near the inside top of said first housing.

3. A fluid-cooled smoking device as set forth in claim 2, wherein said first housing means is contained within said second housing means.

4. A fluid-cooled smoking device as set forth in claim 3, wherein said allowing flow of fluid means is a pressure sensitive one-way valve.

5. A fluid-cooled smoking device as set forth in claim 4, wherein said venting means is of the tubular member type.

6. A fluid-cooled smoking device as set forth in claim 5, wherein said withdrawing said smoke from said second housing means is of the tubular type.

7. A fluid-cooled smoking device as set forth in claim 6, wherein introducing smoke into said first housing means is of the tubular type.

8. A fluid-cooled smoking device as set forth in claim 4, wherein said first housing means is a screw-top container and said second housing means is a screw-top container.

9. A fluid-cooled smoking device as set forth in claim 8, wherein said means for containing a supply of tobacco or/and medicinal herbs is a bowl and within said bowl is a metal screen.

10. A fluid-cooled smoking device as set forth in claim 9, wherein said venting means has attached to its upper end a normally closed pinch valve.

* * * * *